US008776267B2

(12) United States Patent
Narboni-Campora

(10) Patent No.: US 8,776,267 B2
(45) Date of Patent: Jul. 15, 2014

(54) WARM MUFF

(76) Inventor: Chantal Celine Narboni-Campora, New York, NY (US)

( * ) Notice: Subject to any disclaimer, the term of this patent is extended or adjusted under 35 U.S.C. 154(b) by 0 days.

(21) Appl. No.: 13/333,571

(22) Filed: Dec. 21, 2011

(65) Prior Publication Data

US 2013/0160185 A1 Jun. 27, 2013

(51) Int. Cl.
*A41D 19/01* (2006.01)

(52) U.S. Cl.
USPC ..... 2/158

(58) Field of Classification Search
USPC ..... 2/158, 159, 160, 164, 17
See application file for complete search history.

(56) References Cited

U.S. PATENT DOCUMENTS

| | | | | | |
|---|---|---|---|---|---|
| 2,089,086 | A | * | 8/1937 | Farkas | 2/17 |
| 3,397,891 | A | * | 8/1968 | Koch | 473/298 |
| 3,665,515 | A | * | 5/1972 | Sjostrom, Sr. | 2/17 |
| 5,375,263 | A | * | 12/1994 | Cuccia | 2/158 |
| 5,699,632 | A | * | 12/1997 | Stout et al. | 43/25 |
| 5,740,700 | A | * | 4/1998 | Redmond | 74/551.8 |

* cited by examiner

*Primary Examiner* — Tejash Patel
(74) *Attorney, Agent, or Firm* — Volpe and Koenig, P.C.

(57) ABSTRACT

A combination of a stroller and a warm muff. The combination includes the stroller, including at least one handle, the warm muff including, a first end, a second end, an opening in the first end for a hand, a hole through the second end for the at least one handle, wherein the hole is perpendicular to the opening, and a fastener, wherein the warm muff attaches to the at least one handle through the hole in the second end and is fastened to the at least one handle with the fastener.

18 Claims, 3 Drawing Sheets

WARM MUFF

FIELD OF INVENTION

The present invention relates to the field of hand muffs for use in conjunction with handles of a stroller.

BACKGROUND

A muff is generally a thick, tubular case for the hands, covered with fur or other material, used by women for warmth. Hand muffs for use by women, or mothers, generally have slits or openings on both ends through which hands may be received.

The problem with a typical hand muff is that a mother is unable to push the stroller while keeping her hands in the muff at the same time. In addition, a mother pushing a stroller may need an available hand to tend to her child. Once the mother removes her hands from a typical hand muff, the possibility of losing it becomes an issue.

SUMMARY

A combination of a stroller and a warm muff. The combination includes the stroller, including at least one handle, the warm muff including, a first end, a second end, an opening in the first end for a hand, a hole through the second end for the at least one handle, wherein the hole is perpendicular to the opening, and a fastener, wherein the warm muff attaches to the at least one handle through the hole in the second end and is fastened to the at least one handle with the fastener.

BRIEF DESCRIPTION OF THE DRAWINGS

A more detailed understanding may be had from the following description, given by way of example in conjunction with the accompanying drawings wherein.

DETAILED DESCRIPTION

Figure 1:
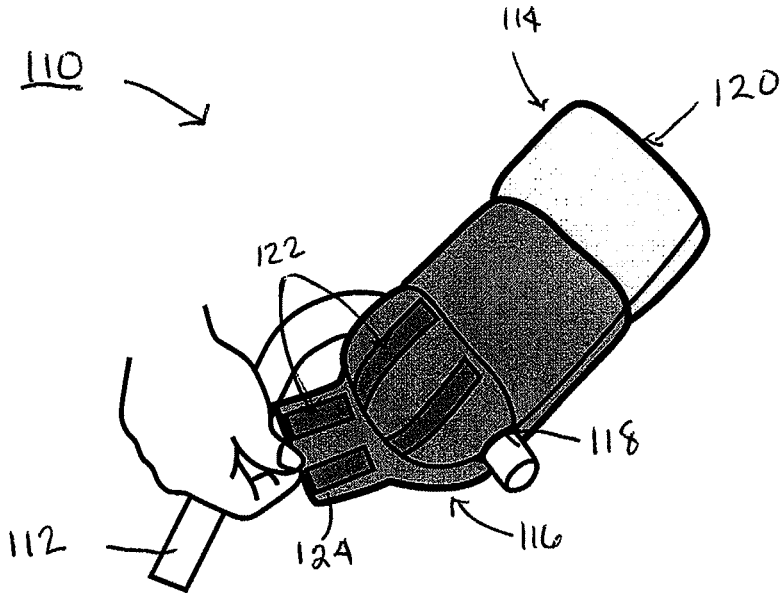
FIG. 1 is a first example of a warm muff with a fastener unfastened.

FIG. 1 is a first example of a warm muff with a fastener unfastened. A warm muff 110 in FIG. 1 comprises a first end 114 and a second end 116. The first end 114 includes an opening 120 for a hand. The second end 116 includes a hole 118 for sliding over a stroller handle 112. Once the warm muff 110 is placed on the stroller handle 112, flap 124 is pulled tightly around the second end 116 and fastened in place with fastener 122. The fastener may be a hook and loop fastener, buttons, snaps, magnets, or a zipper. The stroller handle 112 may be either a single handle, for example on a single bar stroller, or two separate handles, for example on an umbrella stroller.

The opening 120 of warm muff 110 is open the entire length of the warm muff 110, all the way through to the stroller handle 112. This allows a user to have their bare hands pushing the stroller, but still remain warm during cold weather. By allowing the user's hand to be bare, for example without gloves, the user may easily tend to their child. This allows the user to place a hand in the war muff 110 in a closed position around the stroller handle 112. The warm muff 110 eliminates the need for a glove by keeping the user's hand warm. The warm muff 110 attaches to the stroller handle 112, preventing the user from having to worry about losing it.

Figure 2:
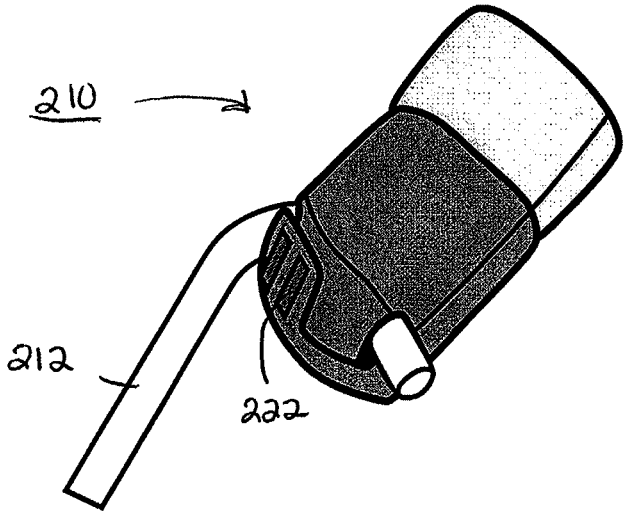
FIG. 2 is a first example of a warm muff with a fastener fastened.

FIG. 2 is a first example of a warm muff with a fastener fastened. FIG. 2 illustrates the warm muff 210 once it is fastened in place on the stroller handle 212.

Figure 3:
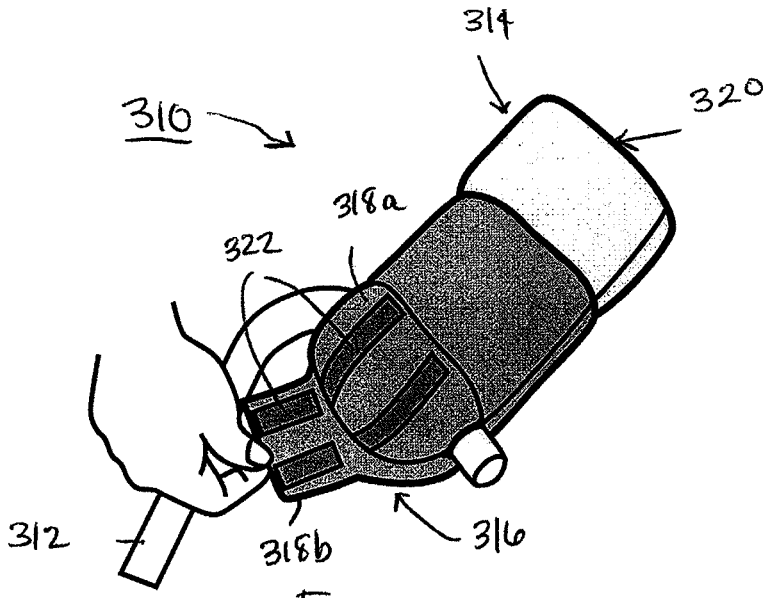
FIG. 3 is a second example of a warm muff with a fastener unfastened.

FIG. 3 is a second example of a warm muff with a fastener unfastened. A warm muff 310 of FIG. 3 comprises a first end 314 and a second 316. The first end 314 includes an opening 320 for a hand. The second end 316 includes two flaps, a first flap 318*a* and a second flap 318*b*. The first flap 318*a* is wrapped around stroller handle 312 while the second flap 318*b* is wrapped around the first flap 318*a*. Once the second flap 318*b* is wrapped around the first flap 318*a*, the second flap 318*b* is fastened to the first flap 318*a* with fastener 322. The fastener may be a hook and loop fastener, buttons, snaps, magnets, or a zipper. The stroller handle 312 may be either a single handle, for example on a single bar stroller, or two separate handles, for example on an umbrella stroller.

Figure 4:
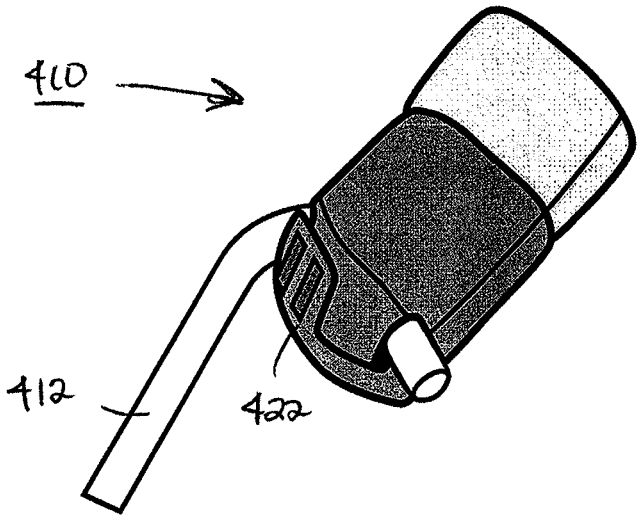
FIG. 4 is a second example of a warm muff with a fastener fastened.

FIG. 4 is a second example of a warm muff with a fastener fastened. FIG. 4 illustrates the warm muff 410 once it is fastened in place on the stroller handle 412.

Figure 5:
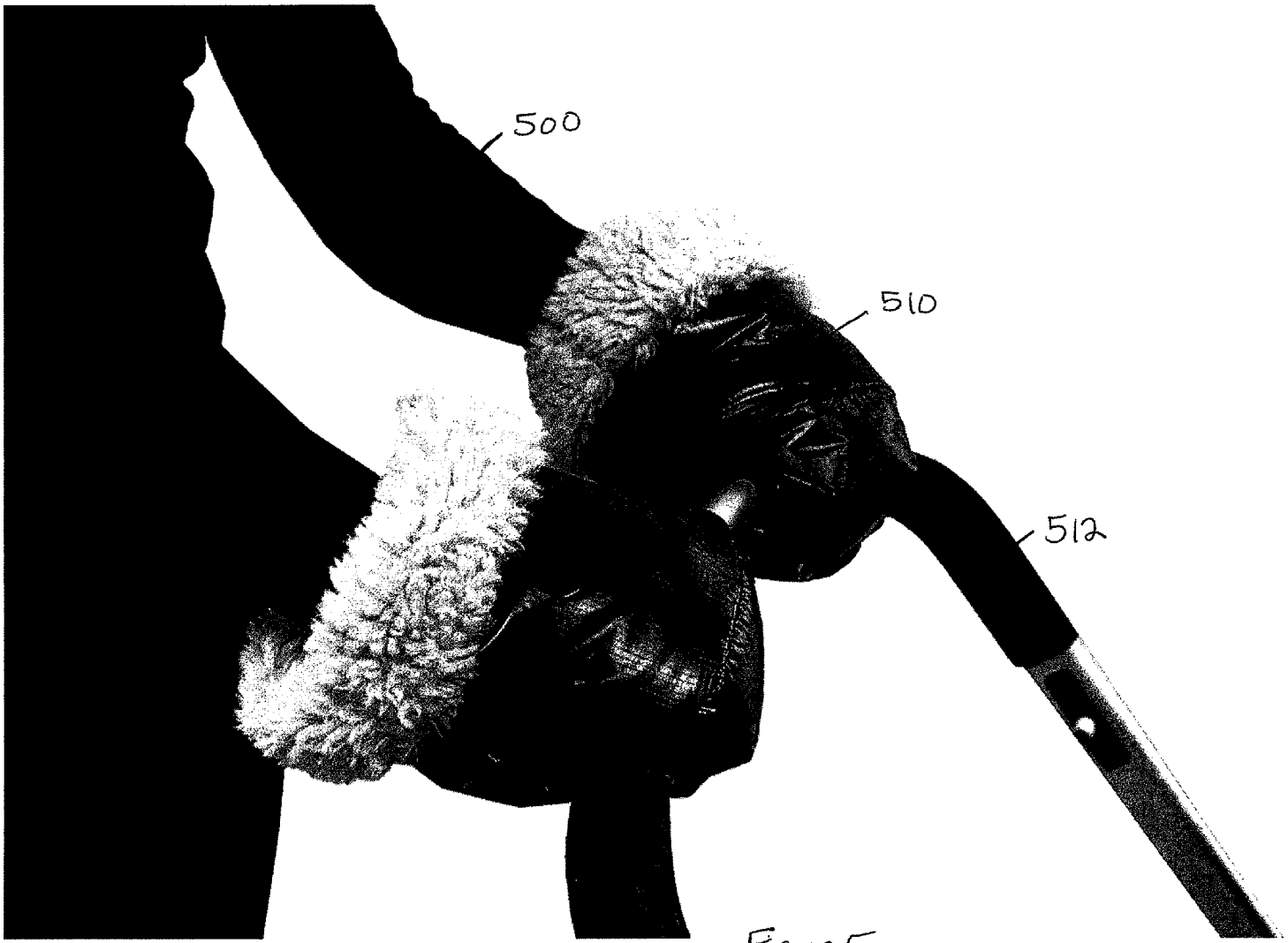
FIG. 5 is an example of a user pushing a stroller using the warm muff.

FIG. 5 is an example of a user pushing a stroller using the warm muff. In FIG. 5, user 500 places hands in warm muffs 510 that are attached to stroller handle 512. The hands of user 500 are in direct contact with the stroller handle 512.

As illustrated in the figures, the warm muff closes at the bottom, underneath the stroller handle. By having the closure at the bottom of the warm muff, no air comes in from the sides.

The warm muff may be lined, quilted, or padded. The lining, for example, may be fur (real or faux), fleece cotton, or thermal.

The warm muff may have lightweight fake down insulation to lower cost.

The warm muff may be spacious enough for both hands and jackets.

The warm muff may be machine washable.

The warm muff may be waterproof, water repellant, or wind proof.

Although features and elements are described above in particular combinations, one of ordinary skill in the art will appreciate that each feature or element can be used alone or in any combination with the other features and elements.

What is claimed:

1. A combination of a stroller and a pair of warm muffs, comprising:

the stroller, including two handles; and each warm muff including:

a first end;

a second end;

an opening in the first end for a hand;

the second end having a first flap and a second flap; and a fastener;

wherein each warm muff attaches to each handle when the first flap is fastened to the second flap using the fastener;

wherein each warm muff slides off each stroller handle to remain on a user's hand; and wherein each warm muff extends half-way up the user's forearm.

2. A combination in accordance with claim 1, wherein the fastener is any one of a hook and loop fastener, buttons, snaps, magnets, and a zipper.

3. A combination in accordance with claim 1, wherein the opening is lined.

4. A combination in accordance with claim 3, wherein the opening is lined with real or faux fur.

5. A combination in accordance with claim 3, wherein the opening is lined with fleece.

6. A combination in accordance with claim 1, wherein the pair of warm muffs are waterproof.

7. A combination in accordance with claim 1, wherein the user is able to place a hand in each warm muff in a closed position around each handle.

8. A method for using a pair of warm muffs attached to a stroller, the method comprising:

providing the stroller having two handles;

providing each warm muff including:

a first end;

a second end;

an opening in the first end for a hand;

the second end having a first flap and a second flap; and a fastener;

attaching each warm muff to each handle when the first flap is brought over the second flap; and fastening each warm muff to each handle with the fastener;

wherein each warm muff slides off each stroller handle to remain on a user's hand; and wherein each warm muff extends half-way up the user's forearm.

9. The method in accordance with claim 8, wherein the second flap has a top and a bottom.

10. The method in accordance with claim 9, wherein the bottom of the second flap is wrapped around the at least one handle and the first flap is fastened to the top of the second flap.

11. The method in accordance with claim 8, wherein the fastener is any one of a hook and loop fastener, buttons, snaps, magnets, and a zipper.

12. The method in accordance with claim 8, wherein the opening is lined.

13. The method in accordance with claim 11, wherein the opening is lined with real or faux fur.

14. The method in accordance with claim 11, wherein the opening is lined with fleece.

15. The method in accordance with claim 8, wherein the warm muffs are waterproof.

16. The method in accordance with claim 8, wherein the user is able to place a hand in each warm muff in a closed position around each handle.

17. A combination in accordance with claim 1, wherein each warm muff falls vertically down each stroller handle when the user's hands are removed.

18. The method in accordance with claim 8, wherein each warm muff falls vertically down each stroller handle when the user's hands are removed.

* * * * *